US006386378B1

(12) United States Patent
Scharing

(10) Patent No.: US 6,386,378 B1
(45) Date of Patent: May 14, 2002

(54) LAUNDRY APPLIANCE ATTACHMENT

(76) Inventor: Martin Scharing, 10024 Branford Rd., San Diego, CA (US) 92129

( * ) Notice: Subject to any disclaimer, the term of this patent is extended or adjusted under 35 U.S.C. 154(b) by 0 days.

(21) Appl. No.: 09/449,051

(22) Filed: Nov. 24, 1999

Related U.S. Application Data

(63) Continuation-in-part of application No. 08/906,785, filed on Aug. 6, 1997, now abandoned.

(51) Int. Cl.[7] ..... A47F 5/00

(52) U.S. Cl. ..... 211/86.01; 211/133.6; 108/90; 312/140.4

(58) Field of Search ..... 219/88.01, 133.6, 219/86.01; 108/90, 42, 47, 152; 312/140.4

(56) References Cited

U.S. PATENT DOCUMENTS 1,627,241 A 5/1927 Johnson
2,590,793 A 3/1952 Rigstad
4,723,583 A 2/1988 Lowe

*Primary Examiner*—Daniel P. Stodola
*Assistant Examiner*—Khoa Tran
(74) *Attorney, Agent, or Firm*—Steins & Associates, P.C.

(57) ABSTRACT

An attachment for a laundry appliance includes a shelf, a first contact surface, and a second contact surface. The first contact surface and the second contact surface are secured to the shelf. The first contact surface engages an appliance front side and a control panel while the second contact surface engages an appliance rear side, below the control panel. Preferably, the attachment includes a third contact surface for engaging an appliance top side and the control panel. The shelf is sized and shaped to substantially fit between the laundry appliance and a wall. The shelf can be used to store laundry supplies and/or wet clothes. Importantly, the shelf inhibits clothes, such as socks from falling between the laundry appliance and the wall.

11 Claims, 5 Drawing Sheets

LAUNDRY APPLIANCE ATTACHMENT

This application is a continuation-in-part of U.S. patent application Ser. No. 08/906,785 filed Aug. 6, 1997, now abandoned.

BACKGROUND OF THE INVENTION

1. Field of the Invention

The present invention is directed to an attachment for a laundry appliance and a laundry appliance which includes an attachment.

2. Description of Related Art

Laundry appliances, such as a laundry washer and a laundry dryer are commonly used in households throughout the world. Depending upon the type of laundry appliance, a number of water hoses, water drains, power cords and/or gas lines must be connected to the laundry appliance in order for the laundry appliance to operate. As a result thereof, the laundry appliance is typically spaced apart from the wall to allow space for connection of the laundry appliance to the water source, water drain, gas line, and/or power cord.

Almost everyone who has recently moved a laundry appliance has discovered the treasures which fall into the space between the laundry appliance and the wall. In fact, the space between the laundry appliance and the wall seems to attract items, such as socks and Further, most laundry appliances lack adequate space for storing laundry supplies or clothing during the transfer of the clothing between the washer and dryer. Moreover, most laundry appliances lack space to store wet clothing during presoaking with a stain remover.

In light of the above, it is an object of the present invention to provide a device and method for reducing the number of objects which fall behind a laundry washer and/or a laundry dryer. Still another object of the present invention is to provide a device for conveniently storing laundry supplies and/or wet clothes near the laundry washer and laundry dryer. Yet another object of the present invention is to provide shelves for a laundry washer and a laundry dryer which are extremely easy to install and durable.

SUMMARY OF THE INVENTION

The present invention is directed to an attachment for a laundry appliance which satisfies these objectives. As described in detail below, the attachment includes a shelf, a first contact surface and a second contact surface. The first contact surface and the second contact surface securely retain the shelf to the laundry appliance. Best of all, the attachment easily attaches to most laundry appliances without drilling holes or modifying a wall of the structure used to house the laundry appliance or the laundry appliances.

As used herein, the term "laundry appliance" refers to and means a laundry washer and/or a laundry dryer.

The shelf covers a gap formed between the wall and the laundry appliance, inhibits clothing, such as socks from falling between the gap, and provides convenient storage for laundry supplies, loose buttons, change, and/or wet clothes. Typically, a shelf having a width of between approximately six (6) inches to twelve (12) inches and a length of between approximately twenty-one (21) inches to thirty-one (31) inches is adequate for covering the gap.

The first contact surface and a second contact surface are secured to the shelf. The first contact surface is adapted to engage a portion of an appliance front side while the second contact surface is adapted to engage a portion of an appliance rear side to selectively retain the shelf to the laundry appliance. Typically, the laundry appliance includes a control panel and the first contact surface is adapted to engage a portion of the appliance front side and the control panel and the second contact surface is adapted to engage the appliance rear side below the control panel.

Preferably, the attachment includes a third contact surface for securely attaching the shelf to the laundry appliance. As provided herein, the third contact surface engages an appliance top side and the control panel. In the embodiments provided herein, the first contact surface and the second contact surface are substantially parallel, while the third contact surface is substantially perpendicular with the first contact surface and the second contact surface.

Typically, the first contact surface, the second contact surface and the third contact surface are positioned on a bracket. In the embodiments provided herein, the attachment includes two brackets to solidly retain the shelf to the laundry appliance. At least one of the brackets can include a flexible support arm which connects the shelf to the second contact surface and allows the second contact surface to rotate relative to the shelf. This feature allows the brackets to dampen impact onto the shelf and handle additional loads.

Additionally, in one embodiment, a lateral distance between the first contact surface and the second contact surface can be selectively adjustable so that the attachment can be attached to laundry appliances having different sized control panels. For this embodiment, the first contact surface and the second contact surface are substantially parallel and positioned on substantially parallel planes. As used herein, the term "lateral distance" shall mean and refer to the distance between the parallel planes. Typically, the lateral distance between the first contact surface and the second contact surface can be selectively adjusted between approximately four (4) inches and twelve (12) inches.

The invention also includes a method for inhibiting an object from falling between the gap formed between the laundry appliance and the wall of the structure. The method includes positioning a shelf proximate the gap and attaching the shelf to the laundry appliance with the first contact surface, the second contact surface, and the third contact surface.

Importantly, the unique design of the brackets allows the attachment to easily and selectively be attached to the laundry appliance. Further, the shelf effectively covers the gap formed between the wall and the laundry appliance. This inhibits clothing from falling into the gap and provides convenient storage for laundry supplies and/or wet clothes.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DETAILED DESCRIPTION OF THE PREFERRED EMBODIMENTS

Figure 1:
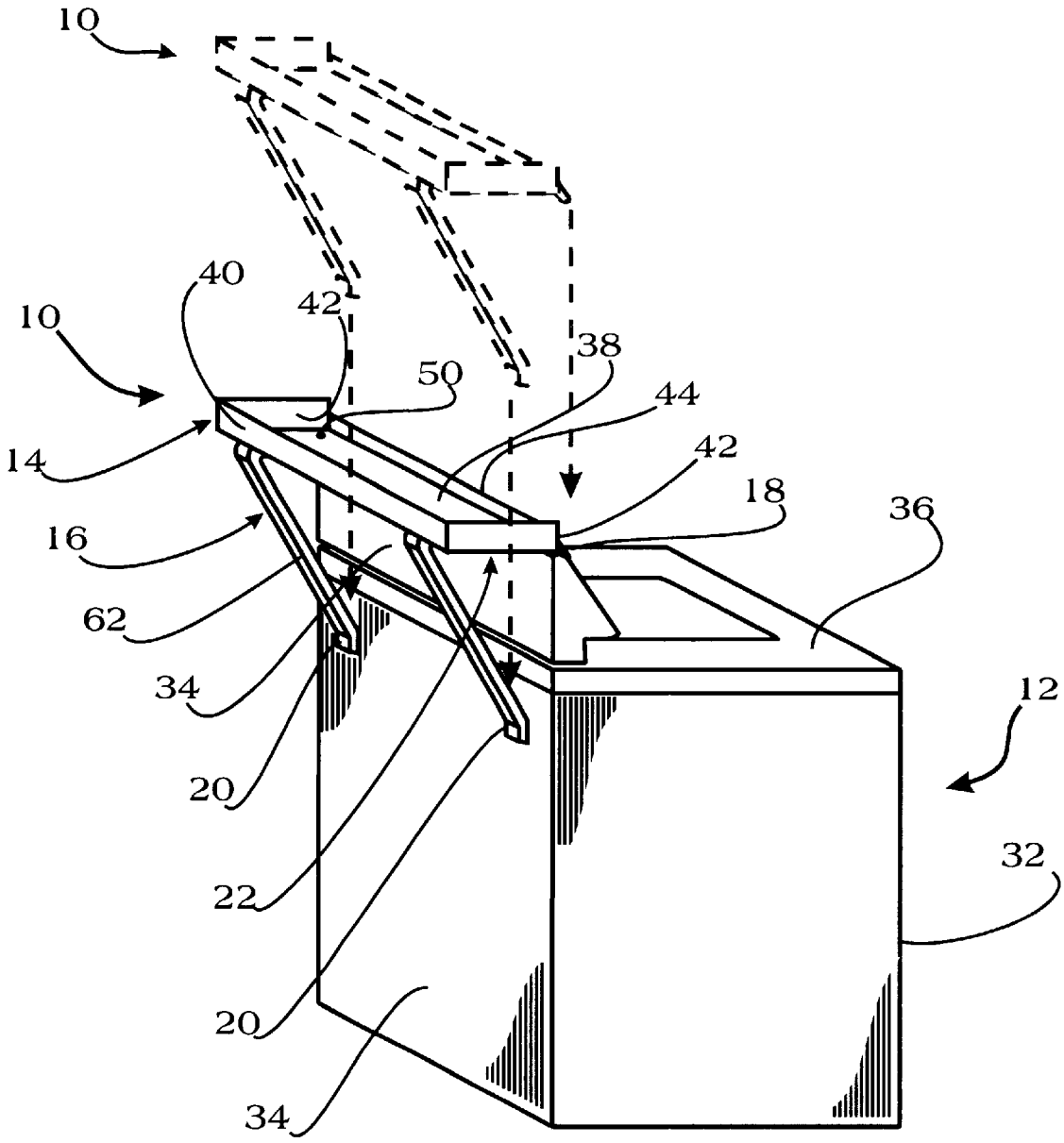
FIG. 1 is a perspective view, of an attachment, a phantom view of the attachment and a laundry appliance having features of the present invention.
Figure 2:
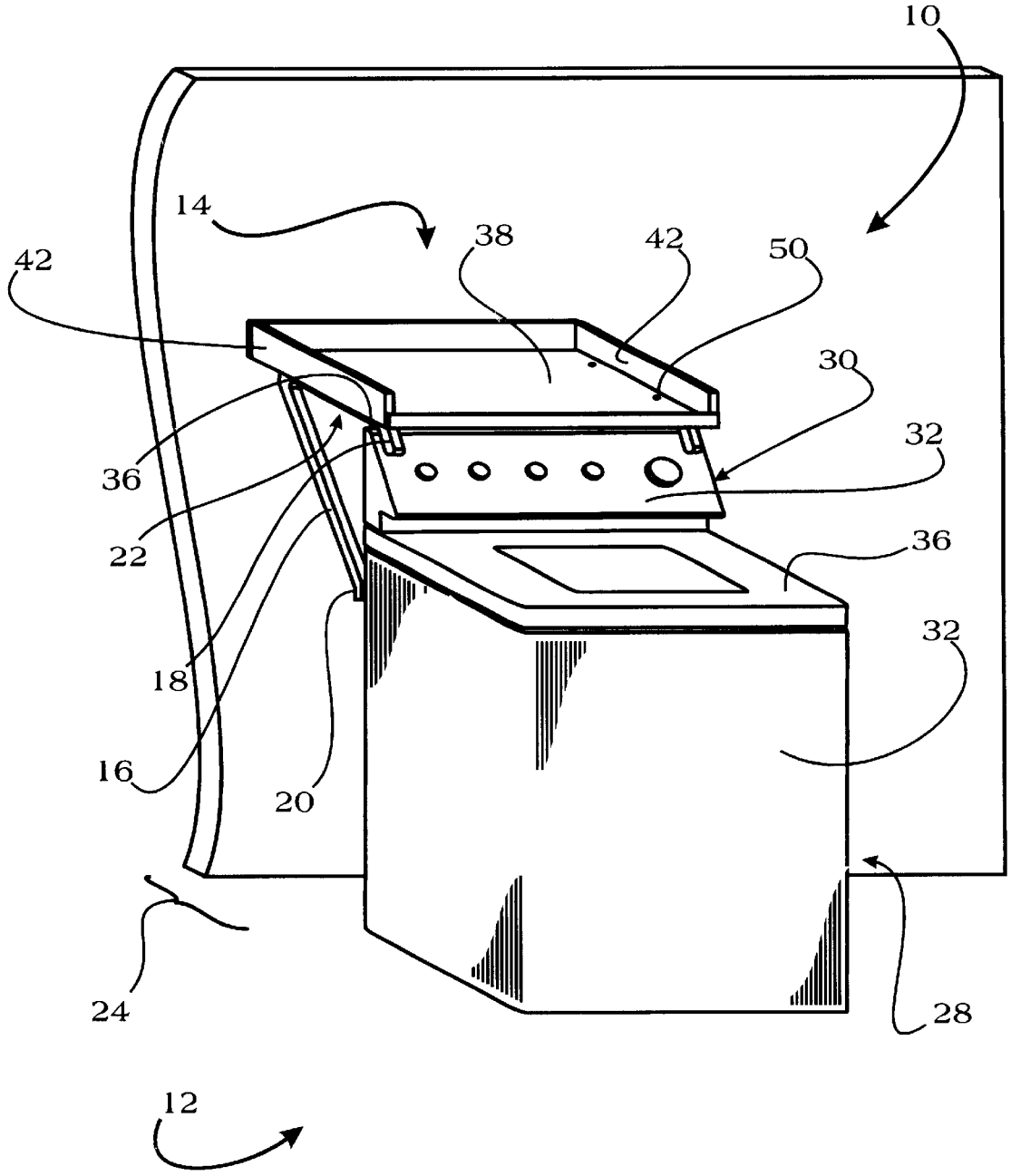
FIG. 2 is a perspective view of the attachment and the laundry appliance of FIG. 1 positioned near a wall.

Referring initially to FIGS. 1 and 2, an attachment 10 for a laundry appliance 12 according to the present invention includes a shelf 14 which is selectively attached to the laundry appliance 12 with brackets 16. Each bracket 16 includes a first contact surface 18, a second contact surface 20 and a third contact surface 22 for quickly and easily attaching the shelf 14 to the laundry appliance 12. As provided herein, the attachment 10 is particularly useful for covering a gap 24 formed between the laundry appliance 12 and a wall 26 of a structure (not shown) which contains the laundry appliance 12. By covering the gap 24, the attachment 10 inhibits clothing (not shown) from falling into the gap 24 and provides convenient storage for laundry supplies (not shown) and/or wet clothes (not shown).

In the embodiment shown in the FIGS. 1 and 2, the laundry appliance 12 includes a substantially rectangular shaped appliance body 28 and a substantially rectangular shaped control panel 30 attached to the appliance body 28. The appliance body 28 and the control panel 30 cooperate to define an appliance front side 32, and appliance rear side 34 and an appliance top side 36.

The shelf 14 is designed to substantially cover the gap 24 formed between the laundry appliance 12 and the wall 26. The shelf 14 can be used for a wide variety of functions including the storage of laundry supplies and accessories, retaining wet clothes which need to be washed or placed into the dryer, and/or retaining folded clothing. In the embodiment shown in the Figures, the shelf 14 is somewhat rectangular shaped and includes a substantially flat shelf bottom 38, a back shelf wall 40, which extends upwardly from the shelf bottom 38 and a pair of spaced apart side shelf walls 42, which also extend upwardly from the shelf bottom 38. Additionally, as can best be seen in FIG. 3, the shelf 14 can also include a front shelf lip 44 which extends upwardly from the shelf bottom 38. Typically, the shelf 14 has a shelf width 46 of between approximately six (6) inches and twelve (12) inches and a shelf length 48 of between approximately twenty-one (21) inches and thirty-one (31) inches. However the shapes and sizes provided herein are mainly for exemplary purposes and those skilled in the art will recognize that a smaller or a larger shelf 14 and/or an alternate shaped shelf 14 may be useful for some versions of the present invention.

The shelf 14 can be made from a number of suitable materials including, for example, any type of plastic or plastic composite, any type of wood, and any type of metal or alloy. Preferably, the shelf 14 is made of a corrosion resistant material for durability. The process utilized for manufacturing of the shelf 14 varies according to the material utilized. For example, a vacuum forming process can be used to manufacture a shelf 14 made from plastic.

As provided above, the shelf 14 is securely attached to the laundry appliance 12 with brackets 16. In the embodiment shown in the Figures, the attachment 10 includes two brackets 16. Alternatively, for example, the attachment 10 can include a single, relatively wide bracket (not shown) which extends substantially the shelf length 48. In yet another embodiment, the attachment 10 can include more than two spaced apart brackets 16.

The brackets 16 can be attached to the shelf 14 in a number of ways. For example, in the embodiment shown in the FIG. 3, each bracket 16 is attached to the shelf 14 with a pair of bolts 50 which mate with a corresponding internally threaded surface 52 in the bracket. Alternately, each bracket 16 can be attached with an adhesive (not shown) or snap fasteners (not shown).

Figure 3:
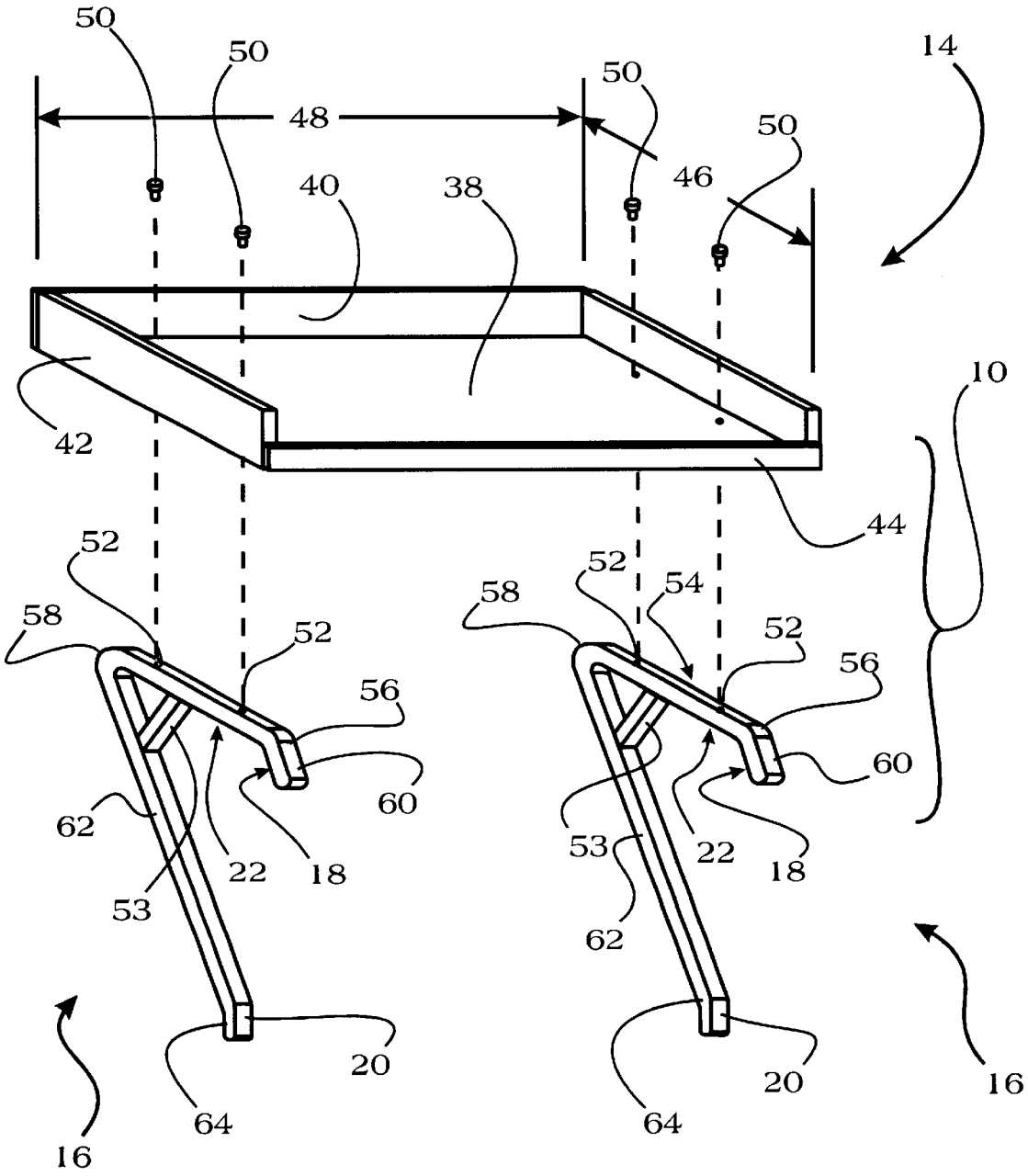
FIG. 3 is an exploded, perspective view of the attachment of FIG. 1.
Figure 4:
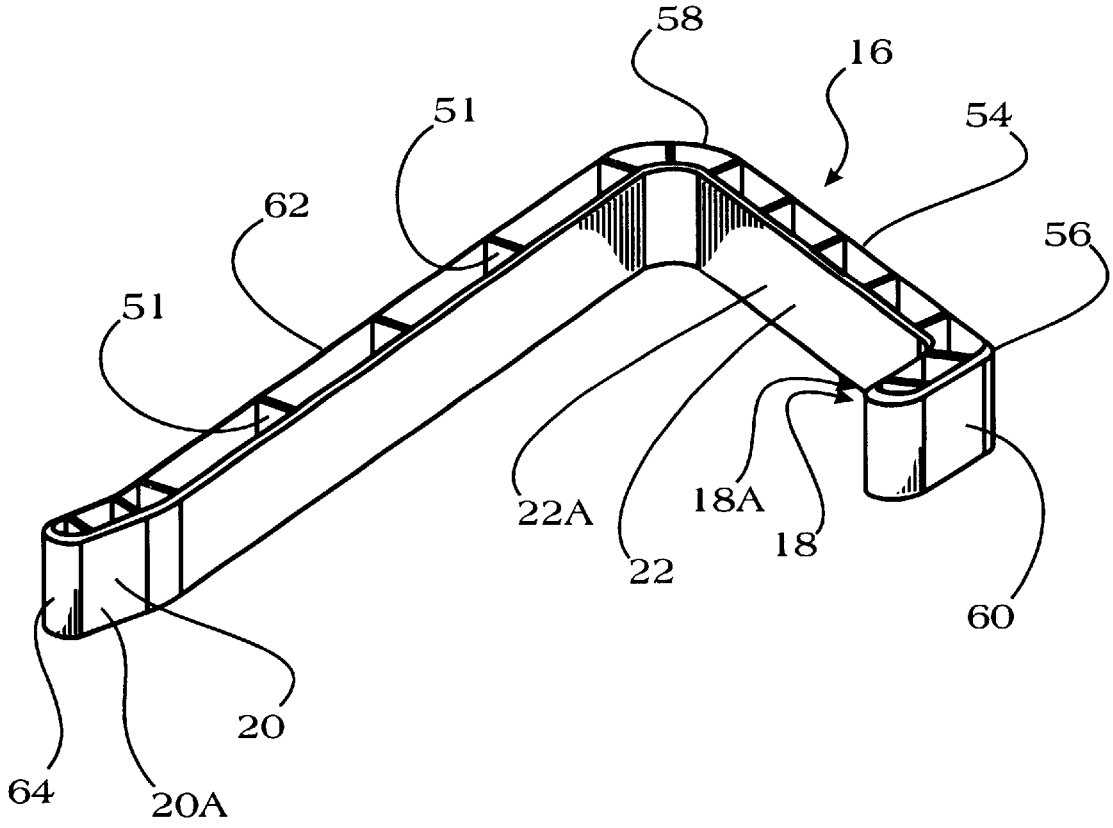
FIG. 4 is a perspective view of an embodiment of a bracket having features of the present invention.
Figure 5:
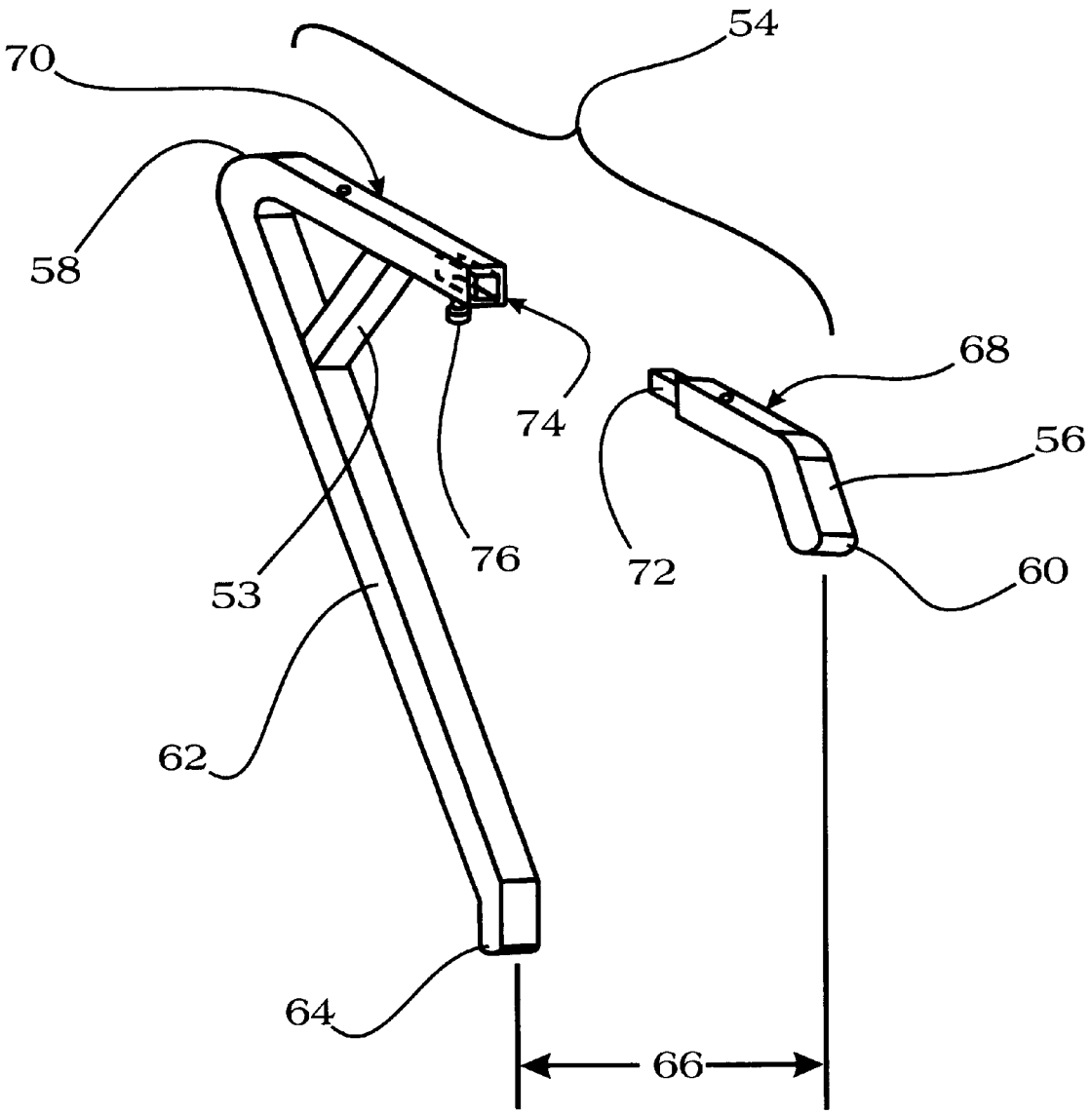
FIG. 5 is a perspective view of another embodiment of a bracket having features of the present invention.

Referring to FIGS. 3–5, in the embodiment shown in the Figures, each bracket 16 is shaped somewhat similar to a number "7". Each bracket 16 includes the first contact surface 18, the second contact surface 20, and the third contact surface 22 to selectively retain the shelf 14 to the laundry appliance 12. However, the shapes and sizes provided herein are mainly for exemplary purposes and those skilled in the art will recognize that alternate shapes and sizes may be useful from some versions of the present invention.

For example, in the embodiments shown in FIGS. 3 and 5, the bracket 16 has a substantially rectangular cross-section. Further, as shown in FIGS. 3 and 5, each bracket 16 can include a brace 53 for strengthening each bracket 16. Alternately, in the embodiment shown in FIG. 4, the bracket 16 has a cross-section which is shaped similar to an "I" and the bracket 16 includes a number of transversely extending support beams 51.

In the embodiments shown in the Figures, each bracket 16 includes: (1) a horizontal section 54 including a front edge 56 and a rear edge 58; (2) a lip 60 which extends downward from the front edge 56; and (3) a support arm 62 which extends downward at an angle from the rear edge 58. In this embodiment, the lip 60 defines the first contact surface 18, the front edge 56 of the horizontal section 54 defines the third contact surface 22 while a distal end 64 of the support arm 62 defines the second contact surface 20. Preferably, the support arm 62 is slightly flexible and allows the second contact surface 20 to rotate relative to the shelf 14. This allows the shelf 14 to absorb shock loads and increases the life of the shelf 14.

Further, in the embodiments shown in the Figures, the first contact surface 18 and the second contact surface 20 are substantially parallel, and the third contact surface 22 is positioned between as is substantially perpendicular to the first contact surface 18 and the second contact surface 20. Additionally, each contact surface 18, 20, and 22 can include an elastic pad (not shown) to inhibit scratching of the laundry appliance 12 and increase the coefficient of friction between each contact surface 18, 20 and 22 and the laundry appliance 12.

As can best be seen in FIGS. 1 and 2, the first contact surface 18 is preferably adapted to engage a portion of the appliance front side 32 and the control panel 30, the second contact surface 20 is adapted to engage the appliance e rear side 34 below the control panel 30 and the third contact surface 22 is adapted to engage the appliance top side 36 and the control panel 30.

Referring to FIG. 5, in some of the embodiments of the present invention, a lateral distance 66 between the first contact surface 18 and the second contact surface 20 can be selectively adjustable. This allows the attachment 10 to securely fit a wide variety of different sized laundry appliances 12. Typically, the lateral distance 66 between the first contact surface 18 and the second contact surface 20 can be selectively adjusted between approximately four (4) inches and twelve (12) inches.

The adjustment of the lateral distance 66 can be accomplished in a number of alternate ways. For example, in the embodiment shown in FIG. 5, the horizontal section can include a first section 68 and a second section 70 which can be moved relative to each other to allow the lateral distance 66 between the first contact surface 18 and the second contact surface 20 to be selectively adjusted. In this embodiment, the first section 68 includes a projection 72 which selectively fits into an aperture 74 in the second section 70. The first section 68 can be secured to the second section 70 by a number of ways, including a set screw 76 or an adhesive (not shown).

Each bracket 16 can be made from a number of suitable materials including, for example, any type of plastic or plastic composite, any type of wood, and any type of metal or alloy. Preferably, each bracket is made of a corrosion resistant material for durability. The process utilized for manufacturing of the bracket 16 varies according to the material utilized. For example, a molding process can be used to manufacture a bracket 16 made from plastic.

Importantly, the present invention covers the gap 24 formed between the laundry appliance 12, inhibits clothing (not shown) and other items from falling into the gap 24 and provides convenient storage for laundry supplies (not shown) and/or wet clothes (not shown).

While the particular attachment as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A shelf system for attaching to a laundry appliance defined by a first, second and third surface, comprising:

a shelf defining a bottom side; and at least one bracket supporting said bottom side, said bracket comprising:

a first unitary bar defined by a horizontal section, said first bar ether terminating in a substantially vertically-downwardly-turned, smooth-tipped front edge end and a rear edge end, said front edge end for engaging said laundry appliance first surface, and said horizontal section for engaging said laundry appliance second surface; and a unitary support arm defined by a downwardly-sloped section rigidly extending from said rear edge end and terminating in a substantially vertically-downwardly-extending opposing distal end, said distal end for engaging said third surface.

2. The system of claim 1, wherein said support arm is flexible.

3. The system of claim 1, wherein said first and second contact surfaces are substantially perpendicular.

4. The system of claim 1, wherein said third contact surface is substantially perpendicular to said second contact surface.

5. The system of claim 1, wherein said first, second and third contact surfaces further comprise an elastic pad.

6. A laundry appliance combination, comprising:

a laundry appliance having a substantially vertical appliance front side, a substantially vertical appliance rear side, a substantially horizontal appliance top side, a control panel; and an attachment comprising a shelf and at least one bracket for selectively securing the attachment to the laundry appliance, each said bracket comprising:

a horizontal section defined by first and second opposing ends, said first end terminating in a smooth-surfaced, downwardly-turned lip, said lip further defining a first contact surface, and said second end terminating in a rear edge;

a downwardly-sloped support arm defined by upper and lower opposing ends, said upper end rigidly extending from said rear edge and said lower end terminating in a substantially vertical downwardly-turned distal end, said distal end further defining a second contact surface; and a third contact surface defined on said horizontal section, said three contact surfaces cooperating together to detachably retain the attachment to the laundry appliance, said first contact surface engaging a portion of the front side and a portion of the control panel, said first contact surface consisting of a substantially flat surface, said second contact surface engaging a portion of the appliance rear side below the control panel, said third contact surface engaging a portion of the appliance top side and the control panel.

7. A shelf assembly for laundry appliances defined by first, second and third surfaces, the assembly comprising:

a bracket member defining:

a unitary horizontal section, said horizontal section having by a pair of opposing ends and a top surface, one said horizontal section end terminating in a substantially vertically and downwardly turned smooth-tipped lip for engaging said laundry appliance first surface and the other said horizontal section end terminating in a rear edge for engaging said laundry appliance second surface; and a unitary support arm having by a pair of opposing top and bottom ends, said top end rigidly extending from said rear edge and slanted downwardly and inwardly from the rear edge to said bottom end, said bottom end terminating in a distal end, said distal end extending vertically downwardly for engaging said third surface; and a shelf attached to said top surface of said horizontal section.

8. The shelf assembly of claim 7, therein said bracket member is formed from a unitary piece of piece of material.

9. The shelf assembly of claim 7, comprising a pair of said bracket members.

10. The shelf assembly of claim 7, wherein said horizontal member and said support arm meet at said rear edge for forming a "V" shape terminating in said lip and said distal end.

11. The shelf assembly of claim 7, wherein said bracket member consists of said horizontal member meeting said support arm at said rear edge to form a "V" shape terminating in said lip defined by said first contact surface and said distal end terminating in said third contact surface, respectively.

* * * * *